US005328247A

United States Patent [19]

Lovins

[11] Patent Number: 5,328,247

[45] Date of Patent: Jul. 12, 1994

[54] EXTENDABLE LEG REST ASSEMBLY FOR A WHEELCHAIR

[75] Inventor: Terrence F. Lovins, Fresno, Calif.

[73] Assignee: Quickie Designs Inc., Fresno, Calif.

[21] Appl. No.: 875,736

[22] Filed: Apr. 29, 1992

[51] Int. Cl.[5] ..... A47C 7/50

[52] U.S. Cl. ..... 297/423.3; 297/423.36; 297/DIG. 4

[58] Field of Search ..... 297/423.26, 423.30, 297/423.36, DIG. 4

[56] References Cited

U.S. PATENT DOCUMENTS

| | | | |
|---|---|---|---|
| 262,311 | 8/1882 | Ortlepp | 297/433 X |
| 453,237 | 6/1891 | Goodwin | 297/433 X |
| 3,453,027 | 7/1969 | Pivacek | 297/433 X |
| 4,333,681 | 6/1982 | Nelson . | |
| 4,486,048 | 12/1984 | Meyer | 297/433 |
| 4,635,999 | 1/1987 | Simpson | 297/433 X |
| 4,893,827 | 1/1990 | Gay et al. . | |
| 4,957,303 | 9/1990 | Romatz | 297/434 X |
| 4,966,379 | 10/1990 | Mulholland . | |
| 4,968,051 | 11/1990 | Luo . | |
| 5,033,793 | 7/1991 | Quintile | 297/433 |

*Primary Examiner*—Peter R. Brown
*Attorney, Agent, or Firm*—Flehr, Hohbach, Test, Albritton & Herbert

[57] ABSTRACT

An extendable leg rest assembly (20) having a footrest device (26) for a wheelchair including a mounting assembly (22) for mounting the leg rest assembly (20) to a frame (10) of the wheelchair. An elongated shaft (40) is pivotally coupled to the mounting assembly (22) to enable pivotal movement of the shaft (40) about a first pivotal axis (45) between a lowered position and a raised position. An elongated extension member (50) is telescopically mounted on the shaft (40) for reciprocating movement relative thereto. Pivotally coupled between the mounting assembly (22) and the elongated extension member (50) is a linkage (28). The linkage (28) pivots about a second pivotal axis (75) on the mounting assembly (22) spaced forwardly from the first pivotal axis (45). Upon pivoting of the shaft member (40) upwardly about the first pivotal axis (45), the linkage (28) causes the extension member (50) to slide outward on the shaft member (40) away from the mounting assembly (22) in response to the pivotal movement of the linkage (28) about the second pivotal axis (75).

17 Claims, 4 Drawing Sheets

EXTENDABLE LEG REST ASSEMBLY FOR A WHEELCHAIR

TECHNICAL FIELD

The present invention relates, generally, to a leg rest assembly for wheelchairs and, more particularly, to leg rest assemblies extendable to an elevated position.

BACKGROUND ART

In recent years, considerable effort has been directed towards wheelchair design in an attempt to make them more portable, as well as lighter in weight. Typically, these wheelchairs are foldable or collapsible to enable portability for transportation purposes. The wheelchair frames are usually formed from high-strength, lightweight, tubular materials such as aircraft-grade aluminum or graphite composites. Moreover, many of the subcomponents are extendable and/or detachable. Leg rest assemblies, for example, are often movably and/or detachably mounted to the wheelchair frames for increased portability.

Some of these leg rest assemblies even provide elevational movement so that a footrest device, which support the user's feet, may be selectively oriented between a raised position and a lowered position. Typically, these leg rest assemblies include a mounting support member mounted to the wheelchair frame, a footrest support member having a footrest device mounted on the distal end thereof, and a pivotal joint coupling the mounting support member to the footrest support member. The pivotal joint axis, or leg rest pivotal axis, typically is horizontally oriented, which permits the footrest device to be raised or lowered relative to the mounting support member. These leg rest assemblies are particularly desirable because the extension of the user's knee and/or legs may be adjusted for therapeutic purposes or for comfort.

Structural limitations often prevent coincidental placement of the leg rest pivotal axis with the pivotal axis of the user's knee. Thus, depending on the location of the leg rest pivotal axis, the distance between the knee and the footrest device may be decreased as the footrest support member is pivotally moved to a raised position. Accordingly, upon pivotal movement of the footrest support member to an elevated position, the footrest device can jam or compress the user's feet, legs or knees. Typical patented, prior art, pivotally-elevated, leg rest assemblies may be found in U.S. Pat. Nos. 4,968,051 to Luo; 4,966,379 to Mulholland; 4,893,827 to Gay et al.; and 4,333,681 to Nelson.

This problem has been overcome by providing a footrest support member which is extendable along a longitudinal axis of the footrest support member when the support member is pivotally raised from the lowered position to the elevated position. Accordingly, as the footrest support member is pivotally moved from a lowered position to an elevated position, the distance between the footrest device and the pivotal joint axis is increased. Such wheelchair leg rest assemblies are disclosed in U.S. Pat. No. 5,033,793 to Quintile; and 4,486,048 to Meyer.

While such prior art, extendable, leg rest assemblies have been able to effectively eliminate jamming or cramping of the feet upon extended elevation, often other problems are inherent in the linkage assemblies employed which extend the footrest devices. These assemblies are often bulky and awkward to operate.

Most current commercially available, extending, leg rest assemblies require additional linkages and mechanisms which are disposed adjacent to the mounting and footrest support members. These linkages are often exteriorly exposed which presents potential safety hazards for the user during operation.

The Quintile patent, for example, discloses a leg rest assembly which includes a mounting support member, a footrest support member, and cooperating gear members which permit pivotal movement. Further, an extendable strut, including a footrest device on one end, is mounted on the opposite end to the footrest support member. An exteriorly exposed linkage assembly, which is operably coupled between the gears and the extendable strut, extends the strut in reaction to the pivotal movement of between the cooperating gears. As the linkage assembly moves relative to the pivotally mounted footrest support member, there is the possibility that an accident may occur. A person of impaired physical ability could easily pinch their appendages and/or get their clothing caught in the linkage or mechanisms during pivoting. Moreover, the Quintile linkage assembly is inherently complex, does not provide smooth transitional extension of the strut and, most importantly, has an exposed linkage mechanism which can endanger the user.

Accordingly, it is an object of the present invention to provide an extendable leg rest assembly which provides extension of a footrest device when raised to an elevated position.

It is another object of the present invention to provide an extendable leg rest assembly which reduces the exposure to injuries during operation.

Still another object of the present invention is to provide an extendable leg rest assembly which facilitates portability of a wheelchair.

It is a further object of the present invention to provide an extendable leg rest assembly which is durable, compact, easy to maintain, has a minimum number of components, is easy to use by unskilled personnel, and is economical to manufacture.

The apparatus of the present invention has other objects and features of advantage which will be more readily apparent from the following description of the Best Mode of Carrying Out the Invention and the appended claims, when taken in conjunction with the accompanying drawing.

DISCLOSURE OF INVENTION

The elevating leg rest assembly of the present invention for a wheelchair having a frame comprises, briefly, a mounting assembly for mounting the leg rest assembly to the frame, an elongated shaft member pivotally coupled at a first shaft end to the mounting assembly for pivotal movement about a first pivotal axis between a lowered position and a raised position, and an elongated extension member having a first extension end telescopically mounted to the shaft member for reciprocal movement of the extension member relative to the shaft member. A footrest is carried by the second extension end of the extension member. Coupled between the mounting assembly and the extension member is a link pivoted about a second pivotal axis spaced from the first pivotal in a direction producing extension of the extension member outward and away from the mounting assembly in response to the pivotal movement of the shaft member to the raised position.

Accordingly, the present invention provides extendable adjustment of the leg rest assembly upon pivotal movement to the raised position.

BRIEF DESCRIPTION OF THE DRAWING

The purpose and advantages of the present invention will be apparent to those skilled in the art from the following detailed description in conjunction with the appended drawings in which.

BEST MODE OF CARRYING OUT THE INVENTION

The extendable leg rest assembly of the present invention permits extension of the leg rest to reduce compression of the user's legs upon elevation of the leg rest. While the present invention will be described with reference to a specific embodiment, the description is illustrative of the invention and is not to be construed as limiting the invention. Various modifications to the present invention can be made to the preferred embodiment by those skilled in the art without departing from the true spirit and scope of the invention, as defined by the appended claims.

Figure 1:
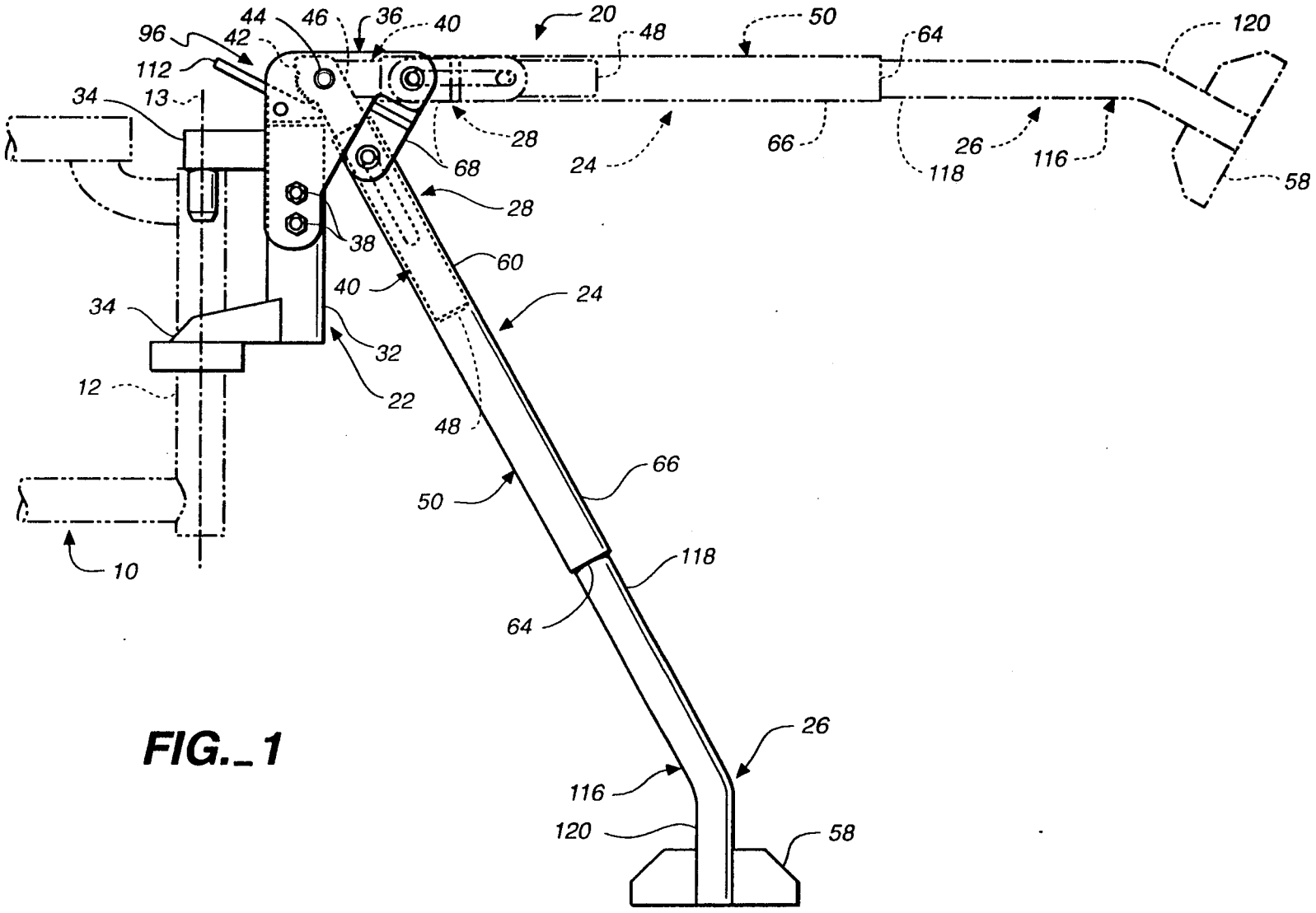
FIG. 1 is a side elevation view of an extendable leg rest assembly constructed in accordance with the present invention and illustrating movement between a lowered position and a raised position.

It will be noted here that for a better understanding, like components are designated by like reference numerals throughout the various figures. Attention is now directed to FIG. 1, where an extendable leg rest assembly, generally designated 20, is illustrated mounted to a wheelchair frame 10 (shown in phantom lines) of a wheelchair (not fully illustrated). Preferably, two mirror-image leg rest assemblies 20 are mounted on opposite sides of wheelchair frame 10, i.e., one for each leg. For ease of understanding, however, only one assembly 20 will be described and illustrated. Briefly, leg rest assembly 20 of the present invention includes mounting means, generally designated 22, formed to releasably mount apparatus 20 to wheelchair frame 10. Pivotally coupled to mounting means 22 is an extendable strut assembly, generally designated 24, having a footrest device 26 on the end thereof. Strut assembly 24 pivots between a lowered position (shown in solid lines in FIGS. 1 and 4) and a raised position (shown in phantom lines in FIGS. 1 and 4). Coupled between mounting means 22 and extendable strut assembly 24 is a link means, generally designated 28, which extends strut assembly 24, and hence, footrest device 26, outward and away from mounting means 22 in response to being pivoted toward the raised position.

Link means 28 is a compact linkage assembly which always remains in close proximity to strut assembly 24 and mounting means 22 so as not to expose the user to possible pinching between the linage and other leg rest components. Prior art extendable leg rests, by contrast, often include complex linkage mechanisms projecting a substantial distance outwardly of the extension members to pose a safety hazard. The compact linkage mechanism 28 of the present invention permits covering of link means 28 under a shield or cover means 30 (FIGS. 2 and 3) without impeding operation of linkage 28. Thus, the wheelchair occupant is protected from sustaining inadvertent injury during raising and lowering of the present leg rest assembly.

Figure 2:
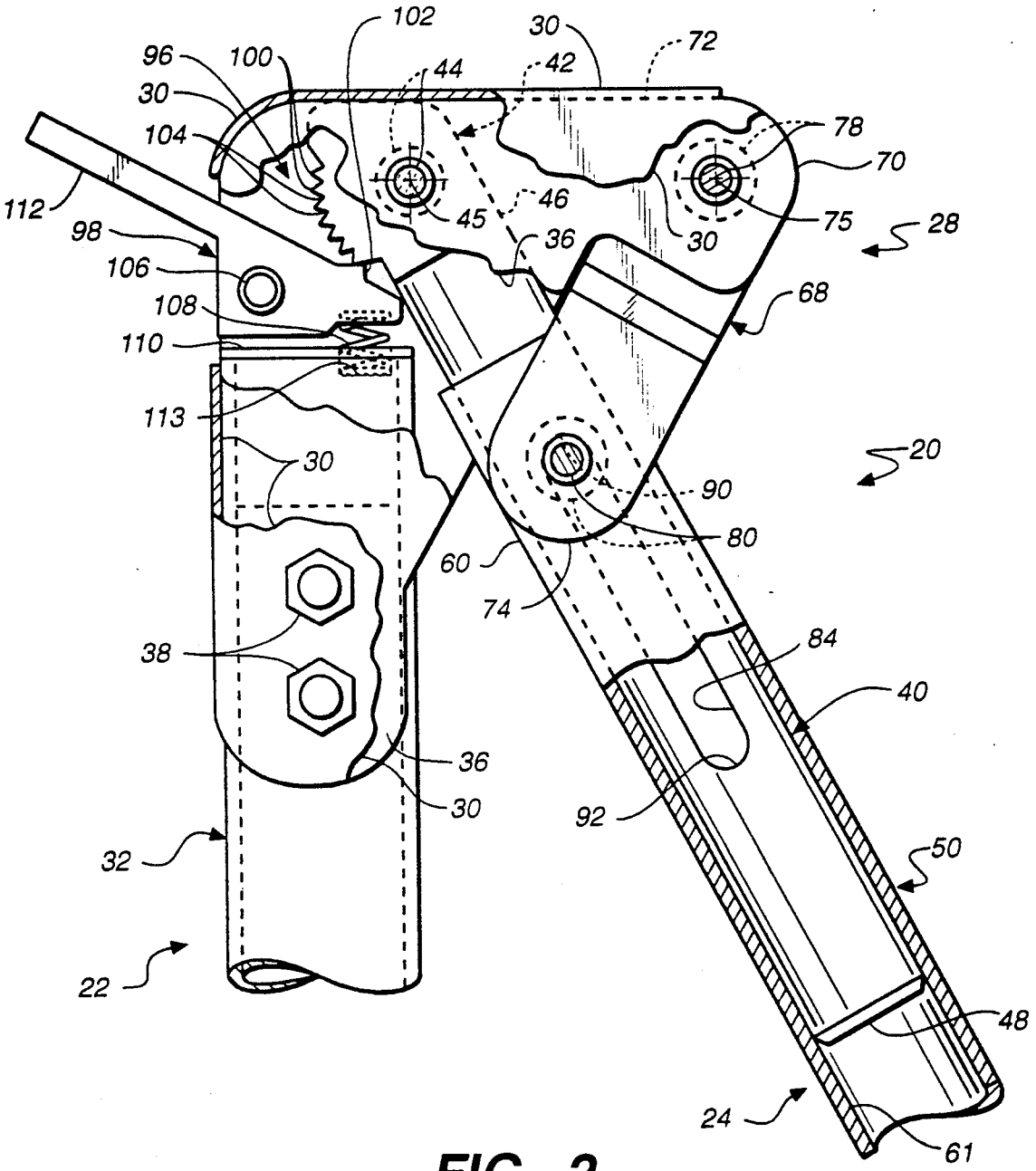
FIG. 2 is an enlarged, fragmentary, side elevation view, partially broken-away, of the extendable leg rest assembly of FIG. 1 in the lowered position.

Turning now to FIGS. 1 and 2, extendable leg rest assembly 20 will be described in greater detail. Mounting means 22 includes a vertical mounting post 32 having a "swing-away" mount and latch mechanism schematically shown at 34 secured thereto. Mount and latch mechanism 34 is formed to removably mount leg rest assembly 20 to a vertically disposed front frame portion 12 of wheelchair frame 10 so that leg rest assembly 20 is placed substantially forward of wheelchair frame 10. As shown in FIG. 1, mount and latch mechanism 34, which latches mounting post 32 juxtaposed to front frame portion 12, permits leg rest assembly 20 to pivot about a vertical axis 13 extending longitudinally through front frame portion 12. Accordingly, leg rest assembly 20 pivots outwardly about the front frame vertical axis to facilitate user ingress and egress from the wheelchair. Preferably, pivotal mount and latch mechanism 34 is a "swing-away" mechanism such as that described in U.S. Pat. No. 4,790,553. It will be appreciated, however, that a variety of other mounting mechanisms may adapted for use with the present invention.

Secured to opposite sides of mounting post 32 and forming part of mounting means 22 are two laterally spaced apart triangular-shaped support gusset plates 36 and 36'. As best viewed in FIG. 3, gusset plates 36 and 36' straddle mounting post 32 and are rigidly mounted thereto by fasteners 38. Plates 36 and 36', therefore, extend upwardly and in a forward direction relative to the upper end of support post 32.

Figure 4:
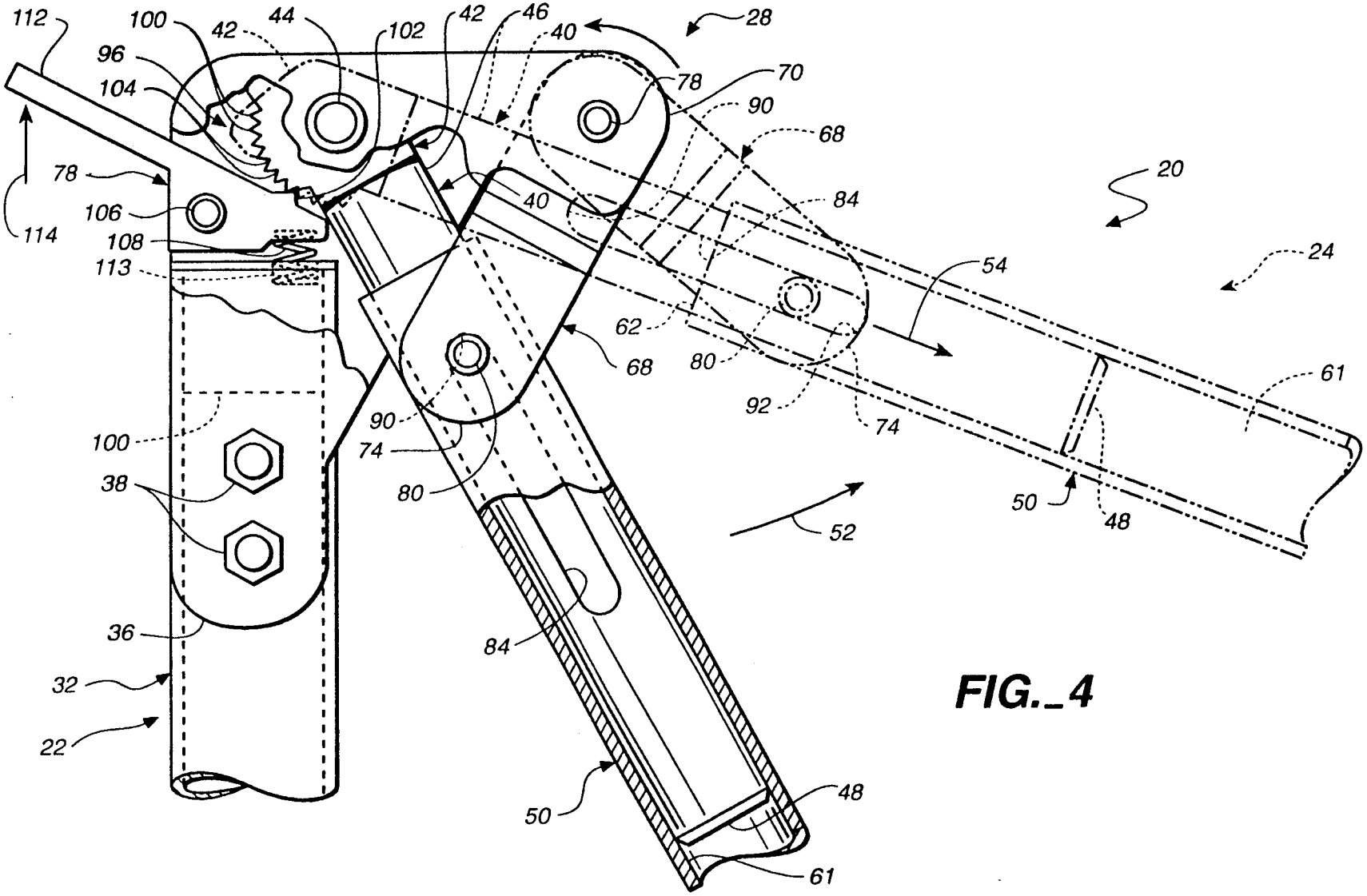
FIG. 4 is an enlarged, fragmentary, side elevation view, partially broken-away, of the extendable leg rest assembly of FIG. 1 and illustrating movement of the linkage mechanism designed in accordance with the present invention.

As best viewed in FIGS. 2 and 4, extendable strut assembly 24 includes an elongated shaft member 40 having a first shaft end 46 pivotally mounted between gusset plates 36 and 36' by a bolt 44. As shown in the drawing, first shaft end 46 is provided with an extension member 42 rigidly secured thereto and having a toothed surface thereon, and pivoting of shaft member 40 is accomplished by bolt 44 which extends through shaft extension member 42. Shaft member 40 rotates about a generally horizontal first pivotal axis 45 coincident with the longitudinal axis of bolt 44. Therefore, extendable strut assembly 24 pivots about first pivotal axis when being raised or lowered, as will be described in greater detail below. Shaft member 40 can be solid or tubular and extension member 42 secured to first shaft end 46 by a fastener or welding.

Mounted on an opposite second shaft end 48 of shaft member 40 is an extension member 50 formed to extend footrest device 26 outward and away from mounting means 22, in response to pivoting of shaft 40 toward the raised position. Thus, as strut assembly 24, including shaft 40 and extension member 50, is rotated in the direction of arrow 52 (counterclockwise in FIG. 4), shaft member 40 is urged outward along the longitudinal axis of shaft member 40 in the direction of arrow 54. This increases the relative distance between a footrest plate 58 of footrest device 26 (FIG. 1) and first pivotal axis 45.

A first extension end 60 of extension member 50 may be telescopically mounted over second shaft end 48 to enable extension of footrest device 26. Preferably, extension member 50 is tubular having an internal bore 61 dimensioned to receive second shaft end 48 so that extension member 50 may slidably reciprocate on shaft 40. It will be understood, however, that a reversal of parts is within the scope of the present invention, namely, telescopic mounting of a tubular shaft (not shown) over the outside of extension member 50.

Figure 3:
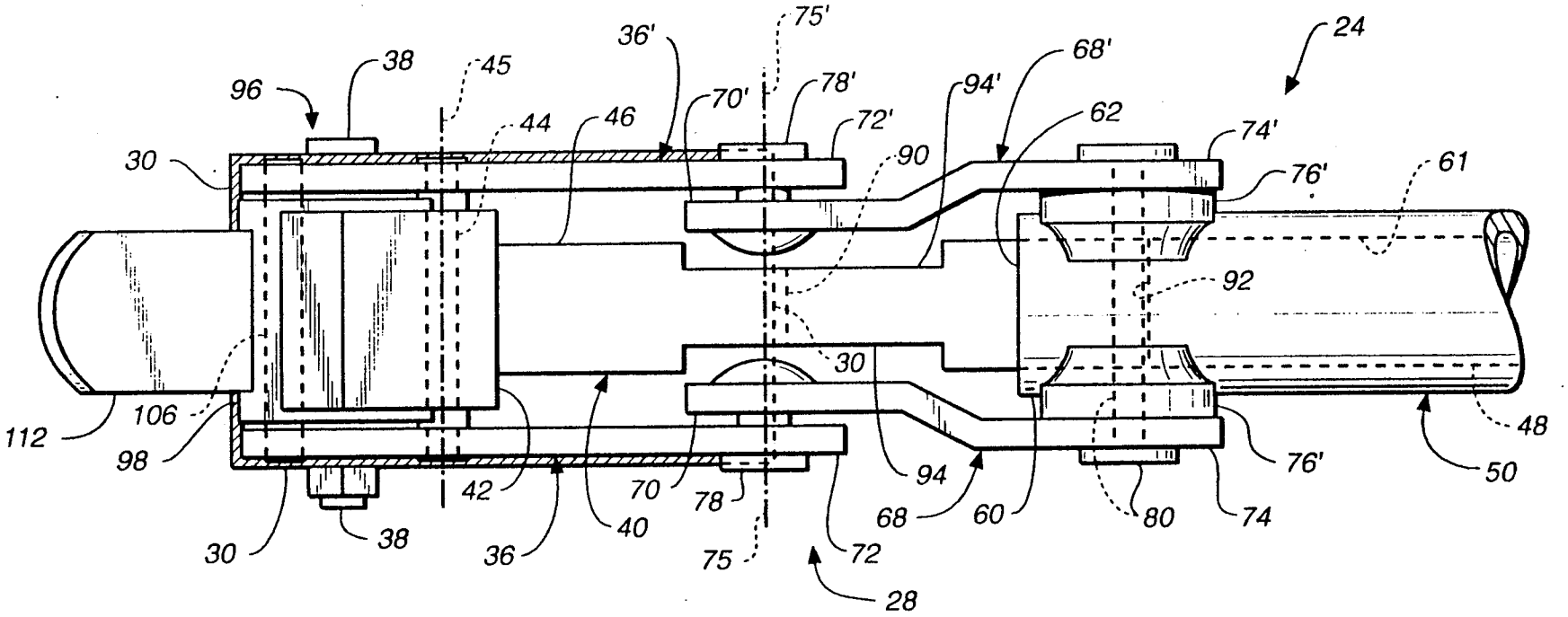
FIG. 3 is an enlarged, fragmentary, top plan view of the extendable leg rest assembly of FIG. 1 illustrated in a fully extended, raised position.

As best viewed in FIGS. 2 and 3, link means 28 includes a pair of link members 68 and 68', pivotally coupled between gusset plates 36 and 36' of mounting means 22 and extension member 50 of extendable strut assembly 24. Preferably, first link ends 70 and 70' of links 68 and 68' are pivotally coupled outwardly for rotation about a second pivotal axis 75 spaced from first pivotal axis 45, namely, to the cantilevered ends 72 and 72' of gusset plates 36 and 36'. Opposite second link ends 74 and 74' are pivotally coupled proximate first extension end 60 to extension member 50. Links 68 and 68' are substantially rigid and, preferably, straddle the opposite sides of first extension end 60 (FIG. 3). Positioned between each link member 68 and 68', and the outer surface of extension member 50 are grommets 76 and 76' formed to matingly engage first extension end 60. Although two links 68 and 68' are employed in the preferred embodiment, it will be appreciated that a single link 68 may be adequate in some designs.

First link ends 70 and 70' are pivotally secured to cantilever ends 72 and 72' of the gusset plates by bolts 78 and 78'. Longitudinal axis 75 of bolts 78 and 78' are aligned along a generally horizontal axis so that links 68 and 68' may pivot thereabout. Thus, both links 68 and 68' simultaneously rotate about bolts 78 and 78'. A single bolt 80 extends laterally through second link ends 74 and 74', grommets 76 and 76', tubular extension member 50 and a slot 84 in shaft member 40 to pivotally secure links 68 and 68' to extension member 50. The longitudinal axis of second link bolt 80 is disposed generally horizontally enabling links 68 and 68' to pivot thereabout.

The forward spacing of second pivotal axis 75 from first pivotal axis 45 causes the outer or second link ends 74 and 74' of links 68 and 68' to swing or pivot outwardly or in a direction away from first pivotal axis 45. Thus, as shaft member 40 is pivoted upwardly (counterclockwise in the FIGURES), link ends 74 and 74', pinned to end 60 of extension tubular member 50, cause the extension member to slide outwardly on shaft 40.

The positioning of second pivotal axis 75 between axis 45 and footrest devices 26, and preferable proximate a radial line therebetween, when the strut assembly is in the raised position, enables extension of the footrest assembly as it is raised while still using a very compact linkage assembly. Thus, the linkage assembly 28 of the present invention can be easily and conveniently covered by cover means 30 and the linkage-extendable strut combination does not open up in a manner enabling the user to inadvertently insert an appendage between the components during the pivoting process.

Movement or reciprocation of tubular extension member 50 may be limited by guide slot 84 in shaft 40. Bolt 80 extends through guide slot 84, as shown in FIG. 2, is provided in shaft 40 to enable reciprocating movement of shaft 40 relative to extension member 50. When extension member 50 telescopically extends relative to shaft 40, the bar portion of bolt 80 slides along guide slot 84 in the direction of arrow 88 until bolt 80 abuts either a first stop end 90 or an oppositely facing second stop end 92 of slot 84. Thus, extendable strut 24 may be retracted and pivoted downward to the lowered position (solid lines) until second link bolt 80 engages first stop end 90 which limits the downward pivotal movement. Similarly, the upward pivotal movement and extension of shaft member 40 relative to extension member 50 is limited at the raised position (phantom lines) when bolt 80 engages second stop end 92.

FIG. 3 illustrates opposing C-shaped recesses 94 and 94' formed in the opposite side portions of shaft 40 which enable shaft 40 to move past the heads of bolts 78 and 78'.

Leg rest assembly 20 also preferably includes ratchet means, generally designated 96, for releasably retaining pivotal shaft member 40 (and extendable strut assembly 24) at any one of a plurality of positions between the fully retracted and lowered position and the fully extended and raised position. Preferably, ratchet means 96 will not impede the upward pivotal movement of extendable strut assembly 24 about bolt 44 when being raised. However, ratchet means 96 will not permit downward pivotal movement about bolt 44 when being lowered, unless ratchet means 96 is released. Ratchet means 96 advantageously can be provided by a plurality of teeth 100 on extension member 42 of pivotal shaft member 40. Teeth 100 can be circumferentially disposed about bolt axis 45, and ratchet means 96 further includes a pawl member 98 having an upstanding elongated rib 102 extending laterally across an upward facing surface of pawl 98. Rib 102 is formed and dimensioned to mesh with the troughs 104 formed between consecutive teeth 100 to prevent downward rotational movement (clockwise in FIGS. 2 and 4) of extendable strut assembly 24. Pawl member 98 is pivotally retained between gusset plates 36 and 36' by ratchet bolt 106, which permits pawl member 98 to pivot about bolt 106.

A spring 108 may also be provided in the ratchet assembly to urge elongated pawl rib 102 upward so that pawl member is biased into a tooth-engaging position. An insert 110 disposed atop the upper distal end of mounting post 32 can be formed with a pocket 113 which seats spring 108. A lever 112 extends rearward from pawl member 98 in a direction away from pivot pin 106 so as to be accessible to the wheelchair occupant. Lever 112 permits the wheelchair occupant to manually disengage ratchet means 96, which enables extendable strut assembly 24 to be pivoted downward. As shown in FIG. 4, when lever 112 is urged upward in the direction of arrow 114, pawl member 98 rotates about ratchet bolt 106 which compresses spring 106. This movement disengages elongated pawl rib 102 from troughs 104, which permits extendable strut assembly 24 to be moved to the lowered position (solid lines) or any one of a plurality of positions therebetween.

FIGS. 2 and 3 illustrate that cover 30 extends over a substantial portion of ratchet means 96 and partially extends over link means 28, which substantially reduces the possibility of injury to the wheelchair occupant. The compact configuration of both link means 28 and ratchet means 96 of the present invention, however, makes it easy to cover the moving and latching components of the present leg rest assembly.

Referring back to FIG. 1, footrest device 26 includes an elongated footrest support tube or member 116 having an end 118 telescopically received in an opening 64 in end 66 of extension member 50. The length of footrest support 116 extending from end 66 of member 50 may be adjusted by a fastener (not shown). Mounted on an opposite end 120 of tubular member 116 may be a footrest plate 58, commonly known in the field.

What is claimed is:

1. An expandable elevating leg rest assembly for a wheelchair comprising:

mounting means for mounting said leg rest assembly to said wheelchair;

an expandable strut assembly pivotally mounted to said mounting means for pivotal movement about a first pivotal axis proximate a distal end thereof between a lowered position and a raised position, said strut assembly including an extension member mounted for movement in a radial direction with respect to said first pivotal axis;

a footrest device carried by said extension member;

link means pivotally mounted proximate one end to said mounting means and pivotally mounted proximate an opposite end to said extension member, said link means being pivotally mounted to said mounting means at a location spaced relative to said first pivotal axis in a direction producing movement of said extension member in a direction away from said first pivotal axis to extend said extension member radially in response to pivotal movement of said strut assembly from said lowered position to said raised position;

a ratchet mechanism coupled between and in axial alignment with both a distal end of said mounting means and said distal end of said strut assembly for releasably retaining said strut assembly at any one of a plurality of positions between said lowered position and said raised position; and cover means extending substantially over and shielding access to said ratchet mechanism;, the pivotal mounting of said strut assembly to said mounting means, and at least a portion of said link means.

2. The extendable elevating leg rest assembly as defined in claim 1, wherein, said one end of the link means is pivotally mounted to said mounting means about a second pivotal axis is located between said first pivotal axis and said footrest device.

3. The extendable elevating leg rest assembly as defined in claim 2 wherein, said second pivotal axis is located proximate a radial line extending between said first pivotal axis and said extension member when said extension member is in said raised position.

4. The extendable elevating leg rest assembly as defined in claim 1 wherein, said ratchet means includes:

a member rigidly fixed to said strut assembly and having a plurality of gear teeth, said member being pivotally mounted about said first pivotal axis to said mounting means; and pawl movably mounted to said mounting means for movement between an engaging position, for meshing engagement of said pawl with said teeth, and a released position.

5. The extendable elevating leg rest assembly as defined in claim 4 wherein, said pawl is mounted for pivotal movement, said ratchet means further includes a lever portion extending away from said pawl and said strut assembly to permit unimpeded manual operable engagement thereof to pivotally move said pawl between said engaging position and said released position, and a compression spring means biasing said pawl member into said engaging position.

6. The extendable elevating leg rest assembly as defined in claim 5 wherein, said cover means includes an opening formed to receive said lever portion therethrough to permit said manual operable engagement.

7. The extendable elevating leg rest assembly as defined in claim 1 wherein, said strut assembly includes a shaft member pivoted proximate a first shaft end to said mounting means for pivotal movement of said shaft member about said first pivotal axis, said extension member is tubular and slidably receives a second shaft end of said shaft member for reciprocal movement thereon.

8. The extendable elevating leg rest assembly as defined in claim 7 further including:

guide means disposed between said shaft member and said extension member for guiding reciprocal movement of said shaft member relative to said extension member.

9. The expendable elevating leg rest assembly as defined in claim 8 wherein, said guide mean is provided by a bar member pivotally coupling said link means opposite end to said extension member and mounted laterally across an interior bore of said extension member proximate said first extension end, and an elongated slot extending through said shaft member, said slot slidably receiving said bar member transversely therethrough such that said bar member slides relative to said slot and said extension member reciprocates relative to said shaft member upon pivoting of said shaft member.

10. The extendable elevating leg rest assembly as defined in claim 9 wherein, said slot of said shaft member provides stop means defined by limiting reciprocal movement of said extension member on said shaft member.

11. The extendable elevating leg rest assembly as defined in claim 1 wherein, said mounting means includes a vertically extending mounting post and a mount and latch assembly secured to said mounting post mounted thereto, said mount and latch assembly being formed and dimensioned for releasable mounting of said leg rest assembly to the wheelchair.

12. The extendable elevating leg rest assembly as defined in claim 11 wherein, said mounting means includes two laterally spaced apart gusset plates secured to opposite sides of said mounting post.

13. The extendable leg rest assembly as defined in claim 12 wherein, said gusset plates have said strut assembly and said link means pivotally connected thereto.

14. The extendable leg rest assembly as defined in claim 1 wherein, said mounting means includes gusset plates enclosing opposed sides of said ratchet means and shielding said strut assembly proximate said first pivotal axis.

15. The extendable leg rest assembly as defined in claim 1 wherein, said link means is provided by a pair of link members each pivoted at first link ends to said mounting means for pivotal movement about a second pivotal axis and each pivoted at second link ends to said extension member.

16. An extendable elevating leg rest assembly for a wheelchair having a frame, comprising:

mounting means for mounting said leg rest assembly to the frame;

an elongated shaft member pivotally coupled at a first shaft end to said mounting means for pivotal movement between a lowered position and a raised position;

ratchet means coupled between and in axial alignment with both a distal end of said mounting means and a distal end of said first shaft end for releasably retaining said shaft member at any one of a plurality of positions along said pivotal movement;

an elongated extension member having a first extension end and an opposite second extension end, said first extension end telescopically coupled to said shaft member for reciprocating movement relative thereto;

guide means disposed between said shaft member and said extension member for guiding said reciprocating movement;

a footrest device carried by said second extension end of said extension member;

link means pivotally coupled to both said mounting means and said extension member at locations producing extension of said extension member outward and away from said mounting means in response to said pivotal movement to said raised position;

a lever extending outward from said ratchet means to a position away from said elongated shaft member and said link means for manual operable engagement of said ratchet means; and cover means extending substantially over and shielding access to said ratchet mechanism, the pivotal coupling of said shaft member to said mounting means, and at least a portion of said link means.

17. The leg rest assembly as defined in claim 16 wherein, said link means is pivotally coupled to said mounting means and said extension member at locations preventing insertion of an appendage between movable components of said leg rest assembly during pivotal movement.

* * * * *

UNITED STATES PATENT AND TRADEMARK OFFICE

CERTIFICATE OF CORRECTION

PATENT NO. : 5,328,247

DATED : July 12, 1994

INVENTOR(S) : Terrence F. Lovins

It is certified that error appears in the above-identified patent and that said Letters Patent is hereby corrected as shown below:

Column 7, lines 5 and 9, Claim 1, delete "expandable" and insert therefor ---extendable---.

Signed and Sealed this

Twenty-fifth Day of October, 1994

*Attest:*

*Attesting Officer*

Bruce Lehman

BRUCE LEHMAN

*Commissioner of Patents and Trademarks*